US007007308B1

(12) United States Patent
Howland et al.

(10) Patent No.: US 7,007,308 B1
(45) Date of Patent: Mar. 7, 2006

(54) PROTECTIVE GARMENT AND GLOVE CONSTRUCTION AND METHOD FOR MAKING SAME

(75) Inventors: Charles A. Howland, Temple, NH (US); Mark A. Hannigan, Wakefield, MA (US)

(73) Assignee: Warwick Mills, Inc., New Ipswich, NH (US)

( * ) Notice: Subject to any disclaimer, the term of this patent is extended or adjusted under 35 U.S.C. 154(b) by 273 days.

(21) Appl. No.: 10/421,214

(22) Filed: Apr. 23, 2003

Related U.S. Application Data

(60) Provisional application No. 60/375,114, filed on Apr. 23, 2002.

(51) Int. Cl.
*A41D 19/00* (2006.01)

(52) U.S. Cl. ..... 2/161.6; 2/2.5; 2/16; 428/911

(58) Field of Classification Search ..... 2/16, 2/20, 161.6, 161.7, 167, 164, 2.5; 428/911, 428/196, 1, 902; 442/134
See application file for complete search history.

(56) References Cited

U.S. PATENT DOCUMENTS

| | | | | |
|---|---|---|---|---|
| 3,821,817 | A | 7/1974 | Jorgensen | |
| 4,183,100 | A | 1/1980 | De Marco | |
| 4,785,479 | A | 11/1988 | Watanabe | |
| 4,847,918 | A | 7/1989 | Sturm | |
| 5,248,548 | A | 9/1993 | Toon | |
| 5,287,690 | A | 2/1994 | Toon | |
| 5,368,930 | A * | 11/1994 | Samples | 428/323 |
| 5,565,264 | A | 10/1996 | Howland | |
| 5,614,305 | A * | 3/1997 | Paine et al. | 428/301.1 |
| 5,822,795 | A | 10/1998 | Gold | |
| 5,837,623 | A * | 11/1998 | Howland | 442/189 |
| 6,021,524 | A * | 2/2000 | Wu et al. | 2/167 |
| 6,044,493 | A * | 4/2000 | Post | 2/167 |
| 6,052,829 | A * | 4/2000 | Kindler | 2/167 |
| 6,081,927 | A * | 7/2000 | Gimbel | 2/161.7 |
| 6,094,748 | A | 8/2000 | Kindler | |
| 6,119,575 | A * | 9/2000 | Dragone et al. | 89/36.05 |
| 6,155,084 | A | 12/2000 | Andrews et al. | |
| 6,185,747 | B1 | 2/2001 | Hughes | |
| 6,272,687 | B1 | 8/2001 | Cunningham | |
| RE37,430 | E | 10/2001 | Toon | |
| 6,360,375 | B1 | 3/2002 | Hart | |
| 6,460,192 | B1 | 10/2002 | Kindler | |

FOREIGN PATENT DOCUMENTS

| | | |
|---|---|---|
| EP | 0 716 817 A1 | 6/1996 |
| EP | 0 748 595 A1 | 12/1996 |
| EP | 0 568 688 B1 | 1/1998 |
| EP | 1 151 682 A1 | 11/2001 |
| JP | 2000-290813 | 10/2000 |
| WO | WO 93/09940 A2 | 5/1993 |

* cited by examiner

*Primary Examiner*—Katherine M. Moran
(74) *Attorney, Agent, or Firm*—Maine & Asmus

(57) ABSTRACT

A system of manufacturing to incorporate protective materials with high cut and puncture resistance into standard safety and apparel products including gloves, to create a highly effective and low cost system of producing safety garments while preserving the characteristics of the original garment. This includes attaching a cut and puncture resistant protective liner or multiple liners to the inside or outside of or within a garment such as a glove by means of adhesives or stitching. The liner may be a protective liner with cut resistance greater than 450 lbs per inch/thickness and/or puncture resistance greater than 50 lbs per inch/thickness depending on the application requirement for protection and dexterity.

39 Claims, 6 Drawing Sheets

PROTECTIVE GARMENT AND GLOVE CONSTRUCTION AND METHOD FOR MAKING SAME

RELATED APPLICATIONS

This application claims the benefit of U.S. Provisional Applications No. 60/375,114, filed Apr. 23, 2002. This application is herein incorporated in its entirety by reference.

FIELD OF THE INVENTION

The invention relates to cut and puncture resistant garments, and more particularly, to a garment, such as a glove, having a resistance to punctures greater than or equal to 50 pounds per inch of thickness and cut resistant properties greater than or equal to 400 pounds per inch of thickness.

BACKGROUND

Hand and arm protection are critical elements in industrial safety. Gloves, sleeves, armbands, vests, coats, pants, leggings, and other protective garments are used to provide this protection. The materials from which they are constructed are fundamental to the level of protection they provide.

The introduction of advanced fiber technology such as para-aramid KEVLAR® brand fibers ushered in a new level of hand and arm and other bodily protection. Flexible and pliable, KEVLAR® brand fiber also provides extremely high strength and cut resistance. As a result, KEVLAR® brand fiber and other para-aramid fibers have been used in many protective items including string-knit gloves and sleeves, vests, coats, pants, leggings and other garments. Applicant makes no claim to the trademark KEVLAR®.

Special machinery designed for string knit processing has been developed over the past few decades, which provide a very low-cost method for producing finished string knit gloves and sleeves in particular. The products primarily provide a synthetic layer of skin over the human skin to provide protection against heat and cuts from sharp objects.

A major drawback with string knit products, however, is the open nature of the knit fabric. To provide the desired flexibility and lower cost, the fibers in the knit products tend to be spaced 1–3 mm (millimeters) apart. As a result, these knitted materials provide no protection against puncture or cut from objects smaller than the interstices of the knitted fabric. In industrial environments as well as the garden, many pointed objects including metal shavings, rose thorns, glass shards, and wood splinters are small enough to cause hand injury, even with the protection of a string knit glove. In addition, string knit structure is not optimized as a cut resistant substrate.

Other protective materials used in safety apparel include leather, rubber, and woven fabrics. However, most materials either cannot provide NPR greater than 50 ppi or are heavy and thick enough to render them unsuitable to the task. Glove liners with no significant puncture resistance have been used in combination with glove shells but are currently used to only improve comfort or thermal insulation.

Puncture resistance of a given material is typically determined as the force required to insert a specified penetrator through the material. Puncture resistance is typically reported as the peak force observed during the test. ASTM D1342 is useful as a gross indicator of puncture resistance, but does not adequately describe the overall material performance capabilities where puncture resistance as well as flexibility, dexterity and tactility are required. Warwick test method WTM-7N05 is used to characterize puncture resistance of materials. This test method is similar to ASTM D1342 with modifications to account for material thickness, field penetrator geometry and optical determination of test end point.

Thickness of a material is directly related to its flexibility and hence its comfort when installed in a product. Normalized puncture resistance (NPR), defined as puncture force divided by material thickness, is used to better differentiate relative puncture performance for a material class:

$$\text{Normalized Puncture Resistance } (NPR) = \frac{\text{Puncture Force}}{\text{Material Thickness}}.$$

For example, the 2 lbf puncture resistance of material A is greater than the 1 lbf puncture resistance of material B. If, however, material A achieves that performance due to a significantly greater thickness, material A may in fact not be the optimum material for a given system. If material A has a thickness 5 times greater than material B, incorporating Material A into an article such as a glove would provide significant penalties for the user in terms of comfort and dexterity. Using the NPR rating of the material, if Material A were 0.10", its normalized puncture resistance is 20 pounds per inch of thickness (20 ppi). By comparison, B would have a thickness of 0.02", and its normalized puncture resistance would be 50 ppi. The normalized puncture resistance (NPR) rating better represents the benefits of material B relative to material A.

In many industrial, commercial and outdoor environments, puncture threats can be significantly smaller than the 0.080" diameter penetrator used in ASTM D1342. Smaller penetrators require less force to pierce a substrate and are often the penetrator types to create failure in a protective system. These small penetrator types such as glass shards, wood splinters, thorns, and snake teeth can become deeply imbedded in a persons body and have the risk of serious infection. In other environments the threat can be the source of dangerous disease as is the case with contaminated fine gauge hypodermic needles. As a result, in the development of specialty PPE glove products, a test probe more representative of these critical threats is highly desirable. In WMT-7N05, a 0.050" sewing needle has been substituted for the 0.080" probe specified in ASTM D1342. Sewing needles are manufactured with reasonable hardness, sharpness and uniformity that make them suitable for use in a test method. They also have a more gradually tapered tip similar to many naturally occurring threats like glass shards, wood splinters and thorns which are much more difficult to stop.

To further improve on the accuracy and repeatability of this test method, multiple needles are used to prevent test bias from an individual needle. Seven (7) needles with two samples per needle are used within a single test and the average of 14 data points are used to represent the puncture resistance of the material. The use of multiple needles adequately compensates for various subtle differences between needles including finish, taper geometry, and sharpness that are non-trivial factors when evaluating protective material puncture resistance fine gage penetrators.

A third preference in optimizing puncture resistance characterization is the procedure used to determine the test end point. A puncture resistant material has failed once the penetrator has broken through the material. As a result, the peak force is not necessarily indicative of the level of protection since the displacement through the material may far exceed the allowable displacement before harm is inflicted on the user. To remedy this discrepancy, an optical test fixture is incorporated into WTM-7N05 to observe when the tip of the penetrator has gone through the material a minimum distance of 0.030" below the bottom surface of the protective material.

Premium cowhide and deerskin leathers have been used for cut/puncture protection, particularly in gloves. A common thickness used in light duty leather gloves is approximately 0.045 inches (1.1 mm) thick. Such a material has been characterized as having a 7 needle puncture resistance of approximately 1.8 lbs force. The resultant normalized puncture resistance (NPR) rating is 40 lbs/inch of thickness. In more heavy duty industrial applications such as veneer plywood manufacturing, much thicker leather materials are used to protect against severe wood splinter threats. With 10 lbs force resistance in the 0.125" material, this leather product with an NPR of 96 ppi is seemingly invincible. However, due to its thickness and cut and sew method of assembly, puncture protection is lost at the seams where virtually no protection is provided. With the simplest stitch through this leather product, the puncture resistance rating drops to 6 ppi, resulting in a product has very poor dexterity and ultimately does not provide the necessary protection.

New classes of textile-based materials, under the trademark TURTLESKIN™, have been developed under U.S. Pat. Nos. 5,565,264, and 5,837,623, which are hereby incorporated by reference for all purposes. TURTLESKIN™ brand and similar materials have been incorporated into specialty gloves using many cut and sew glove designs including those similar to designs described in commonly assigned U.S. Pat. Nos. 6,052,829, 6,094,748, and 6,460,192, which are hereby incorporated by reference for all purposes. These glove types provide excellent hand protection, using TURTLESKIN™ brand fabrics.

These materials are produced from a broad range of fiber types including cotton, polyester, aramid (Nylon), meta-aramid (NOMEX®), para-aramid (KEVLAR®, TWARON®), rayon, polybenzimidazole (PBI), polybenzoxazole (PBO), as well as blends of these and other fiber types. Applicant makes no claim to the trademarks NOMEX®, KEVLAR®, and TWARON®. Based on special fiber blends and densely woven constructions, these fabrics have very high resistance to puncture and cut and also tend to be very thin (less than 0.02", 0.5 mm), providing good flexibility for operations that require tactile sensitivity. In practice, these materials offer a range of puncture protection from NPR of 50 ppi to, or in excess of, 225 ppi, significantly greater than any other polymer, textile, or leather materials commonly used today, particularly in gloves.

When applying the range of TURTLESKIN™ brand puncture resistant materials into protective apparel such as gloves as described by U.S. Pat. Nos. 6,052,829, 6,094,748, and 6,460,192, limitations become apparent due to available cut and sew methods as well costs required to develop a fully custom glove. Because of the wide variety of applications in fields industrial, commercial, civil service, etc. there are nearly infinite combinations of hand and arm protection products used. In many instances, the users have adapted to the feel of existing gloves styles and incorporated that tactility as a control mechanism in the work they perform. Preserving the "feel" and grip provided by the broad range of safety products to the specific applications is highly desirable and hence incorporating these protective materials into existing personal protective equipment product designs without drastically modifying the design of the product is highly desirable.

TABLE 1

| Material type | | Fiber | Thickness (in) | Puncture (lbf) | NPR (lbf/in) |
|---|---|---|---|---|---|
| T9 736 TurtleSkin | #MT1 | Para-Aramid staple | .014 | 2.3 | 164 |
| T9 1010 | #MT2 | Cotton/Para-aramid blend | .013 | 1.0 | 77 |
| 1094 | MT#3 | Para-Aramid | .01 | 0.5 | 50 |
| PalmMaster | MT#4 | Coated Para-Aramid | .017 | 3.8 | 224 |
| Cowhide | MT#5 | | .035 | 1.6 | 46 |
| Split cowhide | MT#6 | | .52 | 3.1 | 60 |
| MT#1 combined with MT#5 | | | .045 | 5.4> 2.3 + 1.6 | 120 |
| MT#2 combined with MT#6 | | | .06 | 5.9> 1.0 + 3.1 | 98 |

BRIEF SUMMARY OF THE INVENTION

A system of manufacturing has been developed to incorporate protective materials with high puncture resistance into standard safety and apparel products to create a highly effective and low cost system of producing safety garments, while preserving the tactile characteristics of the original garment. This invention system includes attaching a puncture resistant material with a NPR greater than or equal to 50 pounds per inch of thickness to the inside or outside of an article such as a glove using an adhesive. In addition to application of this assembly method to this class of puncture resistant materials, the puncture required to penetrate the composite system exceeds the sum of the puncture forces for the constituent layers by at least 25%. This has been shown effective in combining puncture resistant material with NPR greater than 50 ppi with many different material types using less than 50 g/m$^2$ of adhesive including leather goods, assembled knit goods and string knit gloves without the use of additional cut and sew methods described by U.S. Pat. Nos. 6,052,829, 6,094,748, and 6,460,192.

A system of assembly has been developed to create a puncture resistant composite material that provides high dexterity while increasing the overall composite puncture resistance more than puncture resistance of the individual composite layers. For example, a common leather product used in the manufacture of gloves with a material thickness of 0.040"–0.060" (1–1.5 mm) has a puncture resistance of approximately 1.9 lbs using a standard puncture test method with a 0.050" needle. A tightly woven textile material using Fiber system A has a puncture resistance of 1.0 lbs. The anticipated puncture resistance of the combined materials based on addition would be approximately 2.9 lbs. Combining these materials according to one embodiment of the present invention creates a composite material with a net puncture resistance of 5.8 lbs, double the anticipated value.

These multi-layer systems preserve dexterity in the composite, resulting in a highly compliant, highly puncture resistant material that can be used in personal protective equipment such as gloves where both puncture resistance and dexterity are key requirements. Using this method of design and assembly allows for high levels of customization of existing personal protective equipment (PPE) articles based on desired level of protection, area of coverage, and dexterity not previously available using cut and sew methods described by U.S. Pat. Nos. 6,052,829, 6,094,748, and 6,460,192.

DETAILED DESCRIPTION

Figure 4B:
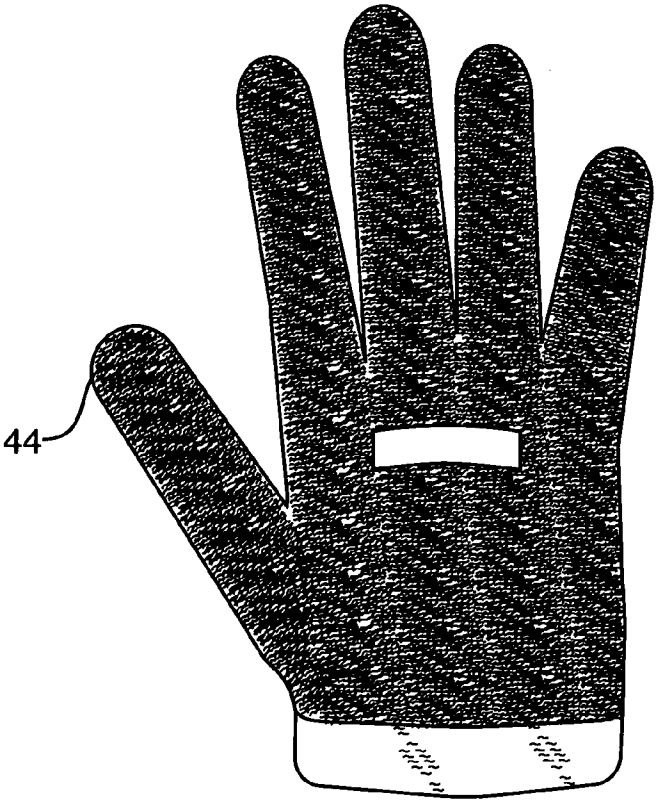
FIG. 4B is a palmer plan view of a two layer cotton string knit glove with integral cuff configured according to one embodiment of the present invention.
Figure 4A:
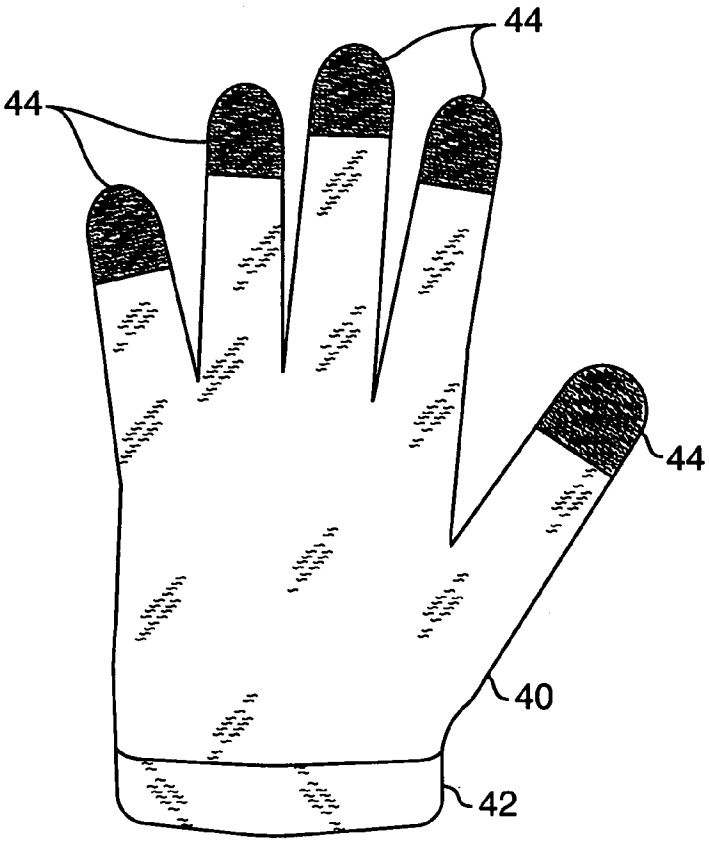
FIG. 4A is a dorsal plan view of a two layer cotton string knit glove with integral cuff configured according to one embodiment of the present invention.

One embodiment uses a palm shaped liner made of a highly puncture resistant fabric described in U.S. Pat. Nos. 5,565,264, and 5,837,623 (hereafter referred to as TURTLESKIN™ brand fabric) combined with a light weight lisle knit cotton glove, manufactured by known methods using a thermoplastic web adhesive. An alternative embodiment would allow for the attachment of a TURTLESKIN™ brand fabric liner to a cotton or aramid or poly/cotton string knit glove. Attaching the TURTLESKIN™ brand fabric liner to the outside of these common textile shells would be an additional variant on these embodiments. A further unique embodiment utilizes a common baseball batters glove as the glove shell to provide a durable leather outer material for grip and abrasion resistance while adding the desired cut and puncture resistance provided by the highly puncture resistant TURTLESKIN™ brand fabrics. Further enhancements include the addition of fold over tabs at the fingertips as illustrated in FIGS. 4*a* and 4*b* to provide seamless protection in this crucial area of the hand. Fold over tabs on the index and pinkie fingers can also be incorporated with this method while preserving dexterity and comfort.

An alternative embodiment utilizes a common baseball batters glove as the glove shell to provide a durable leather outer material for grip and abrasion resistance while adding the desired cut and puncture resistance provided by the highly puncture resistant TURTLESKIN™ brand fabric. Further enhancements include the addition of fold over tabs at the finger tips to provide seamless protection in this crucial area of the hand. Fold over tabs on the index and pinkie fingers are also desirable and feasible with this method.

Figure 1:
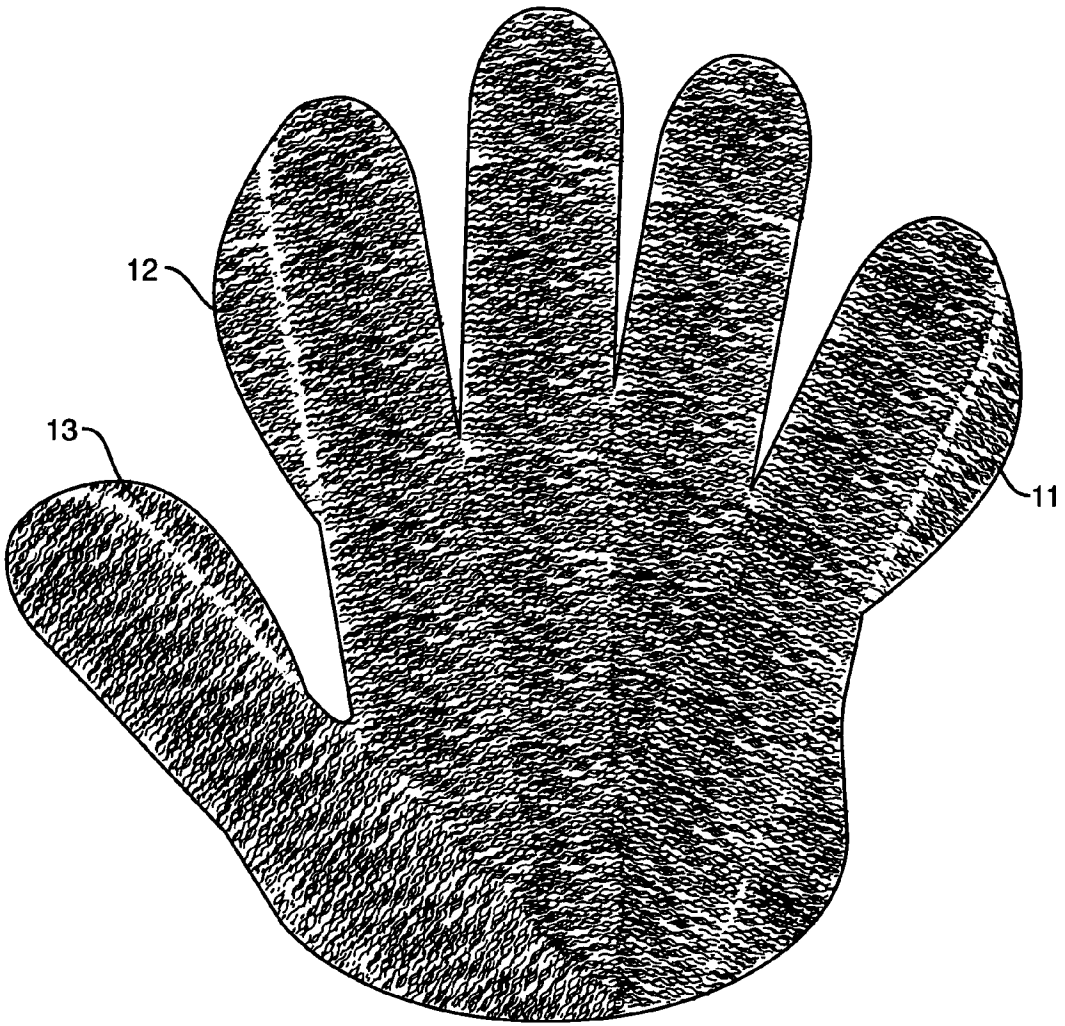
FIG. 1 is plan view of a liner pattern configured in accordance with one embodiment of the present invention illustrating with finger flaps.

As illustrated in FIG. 1, a liner pattern 10, configured according to one embodiment of the present invention in the shape approximating that of the human hand is provided having a plurality of digits extending from a palm, the smallest of these digits, corresponding to the little finger of the hand colloquially known as the pinkie finger, having a outboard pinkie flap 11 for protection of the side of the hand and digits. A similar outboard flap 12 extends from the side of the digit corresponding to the forefinger or index finger so as to provide protection to the side of the hand and in particular the digits. The digit corresponding to the thumb is provided with a similar flap 13 on the inboard side of the thumb. This flap 13 was provided to provide protection of the side of thumb.

Figure 2:
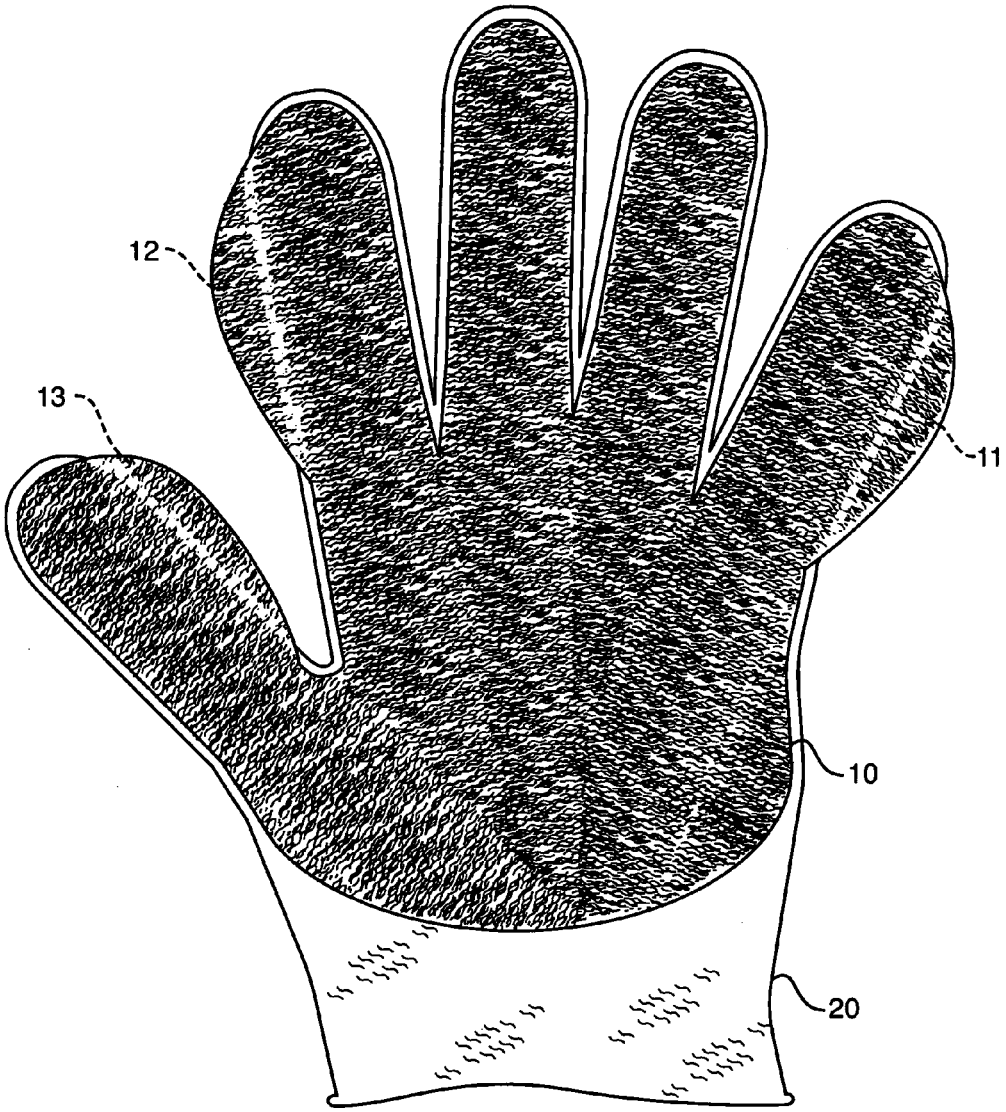
FIG. 2 is a plan view illustrating a liner pattern as in FIG. 1, configured in accordance with one embodiment of the present invention, superimposed on a string knit glove with integral cuff.

Referring now to FIG. 2 in which the liner pattern 10 is superimposed upon the a cotton string knit glove 20 with an integrally attached cuff 22 with intermittent elastic yarns to provide stretch and a form fit, The pinkie flap 11, the forefinger flap 12, and the thumb flap 13 are illustrated to show the amount of overlap extended beyond the side seam of the glove 20 thereby providing seamless protection from penetration and cutting.

Figure 3:
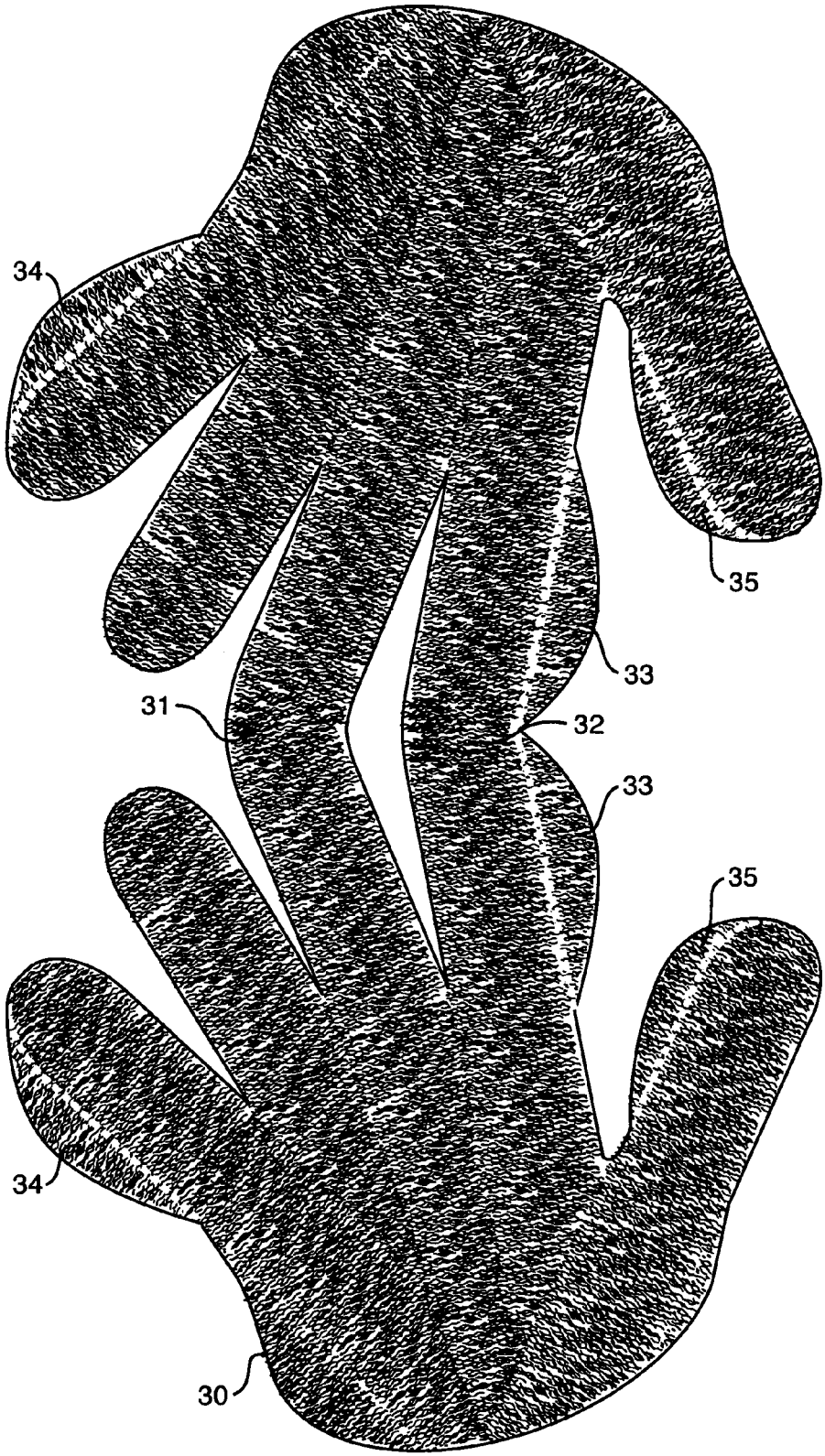
FIG. 3 is a plan view of a one piece palmar and dorsal liner configured according to one embodiment of the present invention, wherein the liner is foldable over two finger tips.

Referring now to FIG. 3, one embodiment of the present invention provides a unitary palmar and dorsal liner 30. According to one embodiment, the shape or pattern of the liner 30 is configured substantially like first and second opposing human hands. The opposing human hands of the pattern are joined by connection points 31 between the tips of the middle fingers of the first and second opposing hands, and connection points 32 between the tips of the forefingers of the first and second opposing hands. These connections effectively provide a continuous, seamless protective layer over these fingertips from front to back, when liner 30 is applied to a glove. Flaps 34, 33, and 35, analogous to flaps 11, 12, and 13 of FIG. 2, are illustrated, attached to their respective digits. One of ordinary skill in the art will readily appreciate that a variety of alternative embodiments are available, wherein connection between the liner patterns is made at other locations that require protection. One such embodiment provides connection along the outboard side of the little finger, thereby offering seamless protection to the lateral side of the hand.

Referring to FIG. 4A which illustrates a plan view of a dorsal side of cotton string knit glove 40 manufactured according to one embodiment of the present invention with an integrally attached cuff 42 with intermittent elastic yarns (not shown) to provide stretch and a form fit. First and second layers 44 of fabric extend over the tips of the digits to further protect the finger tips or, depending on the application, to provide better manual dexterity.

Referring to FIG. 4B, a palmar side of cotton string knit glove 40 with an integrally attached cuff 42 is provided with intermittent elastic yarns (not shown) to provide stretch and a form fit the cuff to the wrist of the wearer or user. The palmar side is formed with a plurality of layers 44 of fabric, re-enforced with puncture and cut resistant fabric. According to one embodiment of the present invention the layers 44 may be bonded using a thermoplastic adhesive. Layers 44 of FIG. 4B extend around the fingertips of FIG. 4A.

Figure 5:
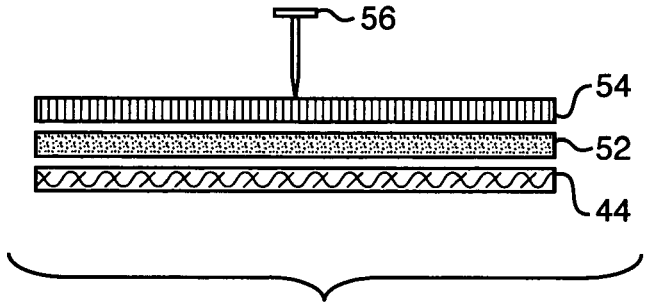
FIG. 5 is a cross sectional view of a garment configured according to one embodiment of the present invention illustrating the application of puncture and cut resistant fabric to the inside of a garment shell using a layer of adhesive.
Figure 6:
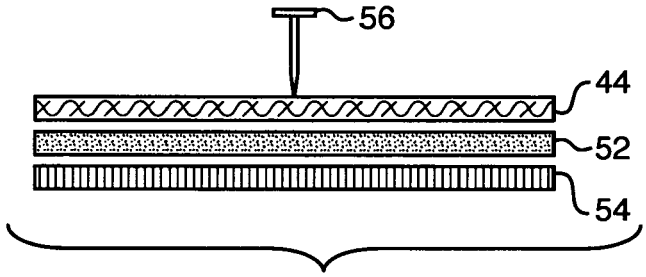
FIG. 6 is a cross sectional view of a garment configured according to one embodiment of the present invention illustrating the application of puncture and cut resistant fabric to the outside of a garment shell.
Figure 7:
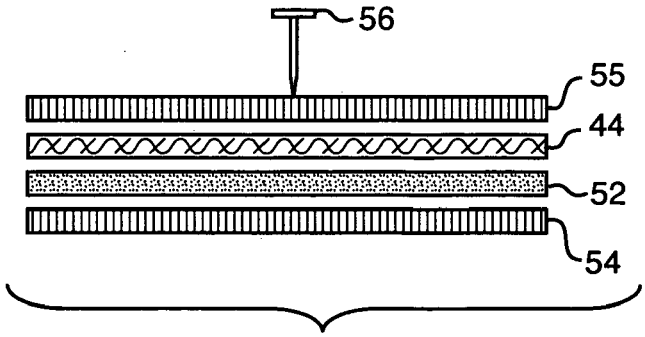
FIG. 7 is a cross sectional view of a garment assembly configured according to one embodiment of the present invention illustrating the application of puncture and cut resistant fabric to the outside of an inner garment shell which is then covered by an outer garment shell.
Figure 8:
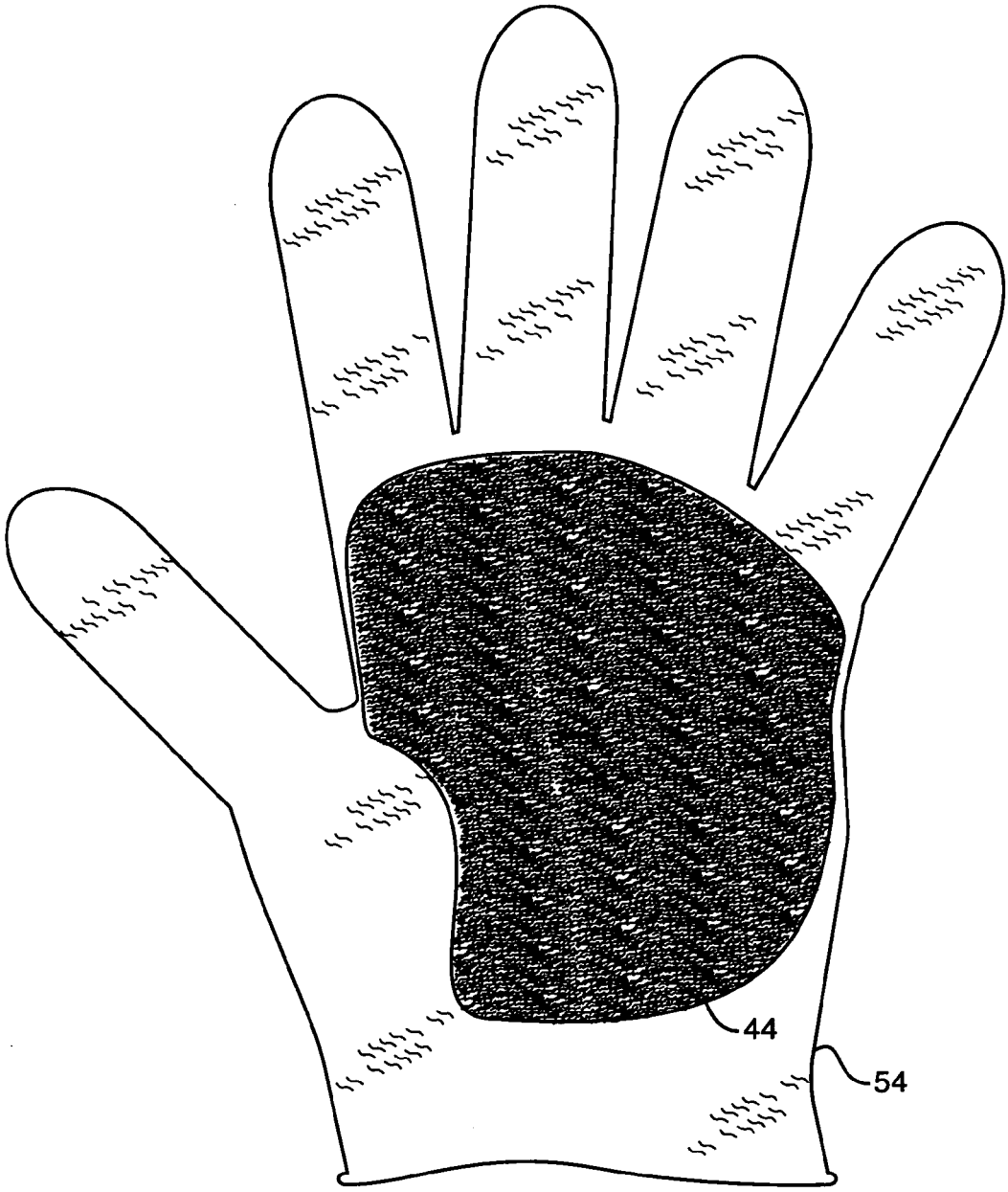
FIG. 8 is a plan view of a glove garment to which a palm size protective layer has been applied.

Referring now to FIG. 5, which illustrate a cross section of a garment configured according to one embodiment of the present invention. A layer 44 of penetration resistant fabric is affixed to the inside of a garment shell 54 with a layer of adhesive 52. This adhesive layer can be continuous or arranged in a configuration suitable for the particular demands of the garment. The laminated configuration illustrated is intended to prevent penetration through layer 44 by penetrator 56. FIG. 6 illustrates an alternative embodiment of FIG. 5, where the layer 44 is applied to the outside of garment shell 54. FIG. 7 illustrates an alternative embodiment of FIG. 6, where the garment assembly includes another garment shell 55 positioned over shell 54 so that layer 44 is in an intermediate layer of the assembly. By way of example of the FIG. 6 configuration of layers, FIG. 8 illustrates a protective layer 44 applied to the palm area of glove shell 54.

Alternative embodiments of the present invention include, but are not limited to, gloves such as string knits, sewn knits, sewn leather, and sewn woven material. Other embodiments include knit sleeves, shirts, vests, pants, overalls, armbands, leggings, stockings, finger guards, and so on. One of ordinary skill in the art. This disclosure is intended to cover the use of this material system in these and related products and hybrids. The inventors are well aware of the application of this technology to the listed products.

However, it is noted that gloves in particular are distinguished from most other common protective garments in their construction and complexity of manufacture, in having small, multiple, closed end appendages (fingers and thumbs), which are not as easily manipulated for inside-out operations as other garments such as coats or trousers. For this reason, the fabrication of gloves has evolved into a relative specialty.

Protective glove products provide protection against such risks as hypodermic needle sticks, lacerations, and punctures. These puncture and cut resistant products may be used in industrial material processing and production environments where risk of cut and stab injury exists, such as, glass, timber and wood products, sheet metal, plastics, mechanical assembly, maintenance, waste sorting, and waste handling.

The invention has been put into practice with several leather and string knit glove designs and sizes. A preferred embodiment includes attachment of a cut pattern similar to a hand shape to the interior of a cotton, poly/cotton or para-aramid string knit glove, sewn knits, sewn leather, and sewn woven material gloves. Patterns may include but are not limited to:

i. Partial or full palm coverage including fingers;
ii. Partial or full back of hand coverage including fingers;
iii. Finger tip coverage by means of wrapping long finger patterns to back of finger;
iv. Side finger coverage by means of wrapping wide finger patterns to side of finger;
v. Any combination of the above variants;
vi. Palm and back of hand patterns protective coverage where the patterns are joined at the index and middle finger providing a continuous protective layer over these finger tips. Alternatively, palmar and dorsal sides of the liner pattern can be joined at other points. One such alternative joint is disposed along the outboard side of the pinkie or little finger, offering continuous, seamless protection to the lateral edge of the user's hand.

Patterns for articles other than gloves may be similarly for optimal areas of protection selected and applied according to various embodiments of the invention.

Coverage may be accomplished by various necessary pattern shapes bonded to the glove or article shell using a monolithic or spunbond adhesive web. Anyone skilled in the art of die cutting and adhesive assembly can create such a product. An adhesive layer may be continuous or intermittent, as for example by using a selected pattern of adhesive attachment offering further advantages in manufacturing or in the performance of the finished product. Other methods of attachment are within the scope of the invention.

Another embodiment may include attachment of a cut pattern by means of an adhesive to the exterior of a glove shell with the intention of wearing yet another glove over the resultant glove assembly. The same methodology applies to other protective garments.

One embodiment of the present invention provides an article of puncture and cut resistant apparel, said article having at least one layer of a first fabric, that first fabric having a puncture resistance of greater than or equal to 50 pounds per inch of thickness and a circular knife resistance of greater than or equal to 400 pounds per inch of thickness, at least one layer of a second fabric, the first fabric being affixed to the second fabric, and the second fabric having exterior and interior surfaces. The second fabric may comprise a fabric chosen from the group of fabrics consisting of leather, cotton, wool, woven natural fibers, woven synthetic fibers, flannels, felts, canvas, knit yarns, latex, rubber, vinyl, nitrile, and neoprene. The first fabric may be bonded to the second fabric with adhesive. That adhesive may form a continuous layer between the first and second fabrics. Alternatively, the adhesive may be disposed intermittently between said first and second fabrics or the first fabric may be affixed to the second fabric with stitching. The first fabric is affixed to the exterior or interior surface of the second fabric.

An alternative embodiment of the present invention provides glove for the protection of a hand of a wearer from punctures or cuts, that glove comprising at least one palmar panel, configured in a geometry approximating that of the user's hand and having five digits extending from a palm, a first digit corresponding to a thumb, a second digit corresponding to a forefinger, a third digit corresponding to a middle finger, a fourth digit corresponding to a ring finger, and a fifth digit corresponding to a little finger or pinkie, at least one dorsal panel, configured in a geometry approximating that of a user's hand and having five digits extending from a palm, a first digit corresponding to a thumb, a second digit corresponding to a forefinger, a third digit corresponding to a middle finger, a fourth digit corresponding to a ring finger, and a fifth digit corresponding to a little finger, and at least one layer of a fabric affixed to the palmer panel, that fabric having a puncture resistance of greater than or equal to 60 pounds per inch of thickness and a circular knife resistance of greater than or equal to 450 pounds per inch of thickness, and the palmar panel being 1.5 times as thick as the dorsal panel.

At least one side protective flaps, may be provided extending from at least one digit of the palmar panel chosen from the group of digits consisting of the first digit, the second digit, and the fifth digit. The palmar panel may further comprise a plurality of layers of material affixed together. Such layers may be affixed by bonding with adhesive. This adhesive may form at least one continuous layer disposed between layers of material.

Another embodiment of the present invention provides a finished apparel product such as a glove having one or more textile based material layers with normalized puncture resistance greater than or equal to 50 lbs per inch of thickness affixed as a separate layer to the outside or inside or intermediate layer of the garment.

One or more puncture resistant layers may be affixed by means of continuous or intermittent adhesive bonding or spun web adhesive. One or more puncture resistant layers may be affixed by means of spun web adhesive with a weight less than 50 g/m$^2$ or may be affixed by means of spun web adhesive with a weight less than 25 g/m$^2$. The one or more puncture resistant layers are affixed by means of (i) continuous and/or intermittent sewing/stitching.

According to one embodiment one or more puncture resistant layers may be affixed by both means described above. One or more puncture resistant layers may be inserted in between two or more layers of material and is held in place without directly affixing the surrounding layers to the puncture resistant layers. Full or partial puncture protection may be, according to one embodiment provided to only to the palm area of the hand using single or multiple patterns, to the palm and fingertip by means of wrapping single or multiple patterns over the finger tips from the palm side or to back of hand only using single or multiple patterns, or full or partial puncture protection may be provided to the back of hand and fingertip by means of wrapping single or multiple patterns over the finger tips from the back of hand side. Full or partial puncture protection is provided to the palm and back of hand by means of wrapping single or multiple patterns over one or more of the finger tips.

We claim:

1. A puncture resistant glove comprising a basic glove with multiple layers including at least one textile based material protective layer having a normalized puncture resistance equal to or greater than 50 lbs per inch of thickness affixed to the basic glove where the composite puncture resistance of the glove in lbf is at least 15% greater than the sum of the puncture resistance of the individual layers.

2. A puncture resistant glove according to claim 1, where puncture protection is provided only to the palm area of the hand by said protective layer.

3. A puncture resistant glove according to claim 1, where puncture protection is provided to the palm and fingertip area of the hand by the pattern of said protective layer extending over the finger tips from the palm side.

4. A puncture resistant glove according to claim 1, where puncture protection is provided to the back area of the hand by the pattern of said protective layer.

5. A puncture resistant glove according to claim 1, where puncture protection is provided to the back of hand and fingertip area by the pattern of said protective layer extending over the finger tip area from the back of hand side of said glove.

6. A puncture resistant glove according to claim 1, where puncture protection is provided to the palm and back of hand area by the pattern of said protective layer extending over the fingertip area of at least one finger from the palm to the back of hand.

7. A puncture resistant glove according to claim 1, where puncture protection is provided to the palm and back of hand area by the pattern of said protective layer extending over the lateral side of said hand from the palm to the back of hand.

8. An article of puncture and cut resistant apparel, said article comprising:

at least one layer of a first fabric, said first fabric having a puncture resistance of greater than or equal to 50 pounds per inch of thickness and a circular knife resistance of greater than or equal to 450 pounds per inch of thickness; and at least one layer of a second fabric, said first fabric being affixed to said second fabric, said second fabric having exterior and interior surfaces.

9. The article of puncture and cut resistant apparel according to claim 8 wherein said second fabric comprises a fabric chosen from the group of fabrics consisting of leather, cotton, wool, woven natural fibers, woven synthetic fibers, flannels, felts, canvas, knit yarns, latex, rubber, vinyl, nitrile, and neoprene.

10. The article of puncture and cut resistant apparel according to claim 8 wherein said first fabric is bonded to said second fabric with adhesive.

11. The article of puncture and cut resistant apparel according to claim 10 wherein said adhesive forms a continuous layer between said first and second fabrics.

12. The article of puncture and cut resistant apparel according to claim 10 wherein said adhesive is disposed intermittently between said first and second fabrics.

13. The article of puncture and cut resistant apparel according to claim 8 wherein said first fabric is affixed to said second fabric with stitching.

14. The article of puncture and cut resistant apparel according to claim 8 wherein said first fabric is affixed to said exterior surface of said second fabric.

15. The article of puncture and cut resistant apparel according to claim 8 wherein said first fabric is affixed to said interior surface of said second fabric.

16. A glove for the protection of a hand of a wearer from punctures or cuts, said glove comprising:

at least one palmar panel, configured in a geometry approximating that of said hand and having five digits extending from a palm, a first said digit corresponding to a thumb, a second said digit corresponding to a forefinger, a third said digit corresponding to a middle finger, a fourth said digit corresponding to a ring finger, and a fifth said digit corresponding to a little finger;

at least one dorsal panel, configured in a geometry approximating that of said hand and having five digits extending from a palm, a first said digit corresponding to a thumb, a second said digit corresponding to a forefinger, a third said digit corresponding to a middle finger, a fourth said digit corresponding to a ring finger, and a fifth said digit corresponding to a little finger; and at least one layer of a fabric affixed to said palmar panel, said fabric having a puncture resistance of greater than or equal to 50 pounds per inch of thickness and a circular knife resistance of greater than or equal to 400 pounds per inch of thickness; said palmar panel being 1.5 times as thick as said dorsal panel.

17. The glove according to claim 16, further comprising at least one side protective flaps extending from at least one digit of said palmar panel chosen from the group of digits consisting of said first digit, said second digit, and said fifth digit.

18. The glove according to claim 16, wherein said palmar panel further comprises a plurality of layers of material affixed together.

19. The glove according to claim 18, wherein said plurality of layers are affixed by bonding with adhesive.

20. The glove according to claim 19, wherein said adhesive forms at least one continuous layer disposed between said layers of material.

21. A puncture resistant finished article of apparel comprising one or more textile based material protective layers with normalized puncture resistance greater than or equal to 50 lbs per inch of thickness affixed as a separate layer to the outside or inside or intermediate layer of the article of apparel, where the composite puncture resistance in lbf is at least 15% greater than the sum of the puncture resistance of the individual layers.

22. A puncture resistant finished article of apparel according to claim 21, said protective layer covering selected areas of said article.

23. A puncture resistant finished article of apparel according to claim 22, said protective layer being affixed thereto by sewing.

24. A puncture resistant finished article of apparel according to claim 21, said protective layer being affixed by a pattern of adhesive to said article.

25. A puncture resistant finished article of apparel according to claim 24, said pattern of adhesive being a continuous pattern of adhesive.

26. A puncture resistant finished article of apparel according to claim 24, said pattern of adhesive being less than a continuous layer of adhesive.

27. A puncture resistant finished article of apparel according to claim 21, said protective layer being affixed by a spun web adhesive.

28. A puncture resistant finished article of apparel according to claim 27, said spun web adhesive weighing less than 50 $g/m^2$.

29. A puncture resistant finished article of apparel according to claim 27, said spun web adhesive weighing less than 25 $g/m^2$.

30. A puncture resistant finished article of apparel according to claim 21, said protective layer being affixed to the inside of said article.

31. A puncture resistant finished article of apparel according to claim 21, said protective layer being affixed to the outside of said article.

32. A puncture resistant finished article of apparel according to claim 21, said protective layer being affixed to an intermediate layer of said article.

33. A puncture resistant finished article of apparel according to claim 21, said article being a glove.

34. A puncture resistant glove comprising at least two layers with at least one of the layers comprising a textile based material layer with normalized puncture resistance greater than or equal to 50 lbs per inch of thickness said at least two layers having a dexterity performance of 4 or better as tested by BS EN 420, where the composite puncture resistance in lbf is at least 15% greater than the sum of the puncture resistance of the individual layers.

35. A puncture resistant glove comprising at least two layers with at least one of the layers comprising a textile based material puncture resistant layer with normalized puncture resistance greater than or equal to 50 lbs ner inch of thickness said at least two layers having a dexterity performance of 4 or better as tested by BS EN 420, and where one or more said puncture resistant layers are inserted in between two or more layers of material and is held in place without directly affixing the surrounding layers to the puncture resistant layers.

36. A glove item comprising at least two layers with at least one of the layers comprising a textile based material layer(s) with normalized puncture resistance greater than or equal to 50 lbs per inch of thickness, said at least two layers having a total thickness of less than 0.070".

37. A glove item as in claim 36 where the composite puncture resistance in lbf is at least 15% greater than the sum the puncture resistance of the individual layers.

38. A glove item as in claim 36 where one or more puncture resistant layers are affixed by means of continuous or intermittent adhesive bonding.

39. A glove item as in claim 36 where one or more puncture resistant layers are affixed by means of spun web adhesive.

* * * * *